US006661990B2

(12) United States Patent
Pirwitz

(10) Patent No.: US 6,661,990 B2
(45) Date of Patent: Dec. 9, 2003

(54) FUSING APPARATUS HAVING A PNEUMATIC MEMBER

(75) Inventor: Robert G. Pirwitz, Pittsford, NY (US)

(73) Assignee: Xerox Corporation, Stamford, CT (US)

( * ) Notice: Subject to any disclaimer, the term of this patent is extended or adjusted under 35 U.S.C. 154(b) by 0 days.

(21) Appl. No.: 10/041,100

(22) Filed: Jan. 9, 2002

(65) Prior Publication Data

US 2003/0129007 A1 Jul. 10, 2003

(51) Int. Cl.[7] ..... G03G 15/20

(52) U.S. Cl. ..... 399/328; 219/216; 399/330; 432/60

(58) Field of Search ..... 399/67, 320, 328, 399/330, 331; 219/216; 432/60

(56) References Cited

U.S. PATENT DOCUMENTS 4,512,649 A * 4/1985 Derimiggio ..... 219/216 X
5,138,379 A 8/1992 Kanazashi
5,276,493 A 1/1994 Hediger et al.
5,286,948 A 2/1994 Landa et al. ..... 219/216
5,998,761 A * 12/1999 Berkes et al. ..... 219/216

FOREIGN PATENT DOCUMENTS

JP 59-018975 1/1984
JP 61-018984 1/1986
JP 62-242980 10/1987

OTHER PUBLICATIONS

European Search Report.

* cited by examiner

*Primary Examiner*—William J. Royer
(74) *Attorney, Agent, or Firm*—Tallam I. Nguti

(57) ABSTRACT

A compact long nip fusing apparatus including (a) a frame; (b) a rotatable first member for mounting to the frame; (c) a heat source for heating the rotatable first member; and (d) a rotatable and compressable pneumatic member forming a long fusing nip against the rotatable first member for contacting and fusing a fusible image.

20 Claims, 2 Drawing Sheets

FUSING APPARATUS HAVING A PNEUMATIC MEMBER

BACKGROUND OF THE INVENTION

This invention relates generally to electrostatographic reproduction machines, and more particularly to a fusing apparatus including a pneumatic member for increasing fusing nip width, and fusing dwell time.

In a typical electrophotographic printing process, a photoconductive member is charged to a substantially uniform potential so as to sensitize the surface thereof. The charged portion of the photoconductive member is exposed to selectively dissipate the charges thereon in the irradiated areas. This records an electrostatic latent image on the photoconductive member. After the electrostatic latent image is recorded on the photoconductive member, the electrostatic latent image is developed by bringing a developer material into contact therewith. Generally, the developer material comprises toner particles adhering triboelectrically to carrier granules. The toner particles are attracted from the carrier granules either to a donor roller or to an electrostatic latent image on the photoconductive member and form a toner powder image on the photoconductive member. The toner powder image is transferred from the photoconductive member to a copy substrate. The toner powder image is then heated to permanently fuse and affix it to the copy substrate.

In order to fix or fuse toner material onto a support member permanently by heat, it is necessary to elevate the temperature of the toner material to a point at which constituents of the toner material coalesce and become tacky. This action causes the toner to flow to some extent onto the fibers or pores of the support members or otherwise upon the surfaces thereof. Thereafter, as the toner material cools, solidification of the toner material occurs causing the toner material to be bonded firmly to the support member.

One approach to thermal fusing of toner images onto a supporting substrate has been to pass the substrate with unfused toner images thereon between a pair of opposed roller members at least one of which is internally heated, i.e. a heated fuser roller. During operation of a fusing system of this type, the substrate to which the toner images are electrostatically adhered is moved through a nip formed between the roller members with the toner image contacting the heated fuser roller to thereby effect heating of the toner images within the nip. In a Nip Forming Fuser Roller (NFFR), the heated fuser roller is provided with a layer or layers that are deformable by a harder pressure roller when the two rollers are pressure engaged. The length of the nip determines the dwell time or time that toner particles remain in contact with the surface of the heated fuser roller.

Roller fusers work very well for fusing color and monochrome images at low speeds since the required process conditions such as temperature, pressure and dwell time can easily be achieved. When process speeds approach 100 pages per minute (ppm) roller fusing performance starts to falter. At such high speeds, dwell time must remain constant which necessitates an increase in nip width. Increasing nip width can be accomplished most readily by either increasing the fuser roller (FR) rubber thickness and/or the outside diameter of the fuser roller. Each of these solutions reach their limit at about 100 ppm. Specifically, the rubber thickness is limited by the maximum temperature the rubber can withstand and the thermal gradient across the elastomer layer. The fuser roller size becomes a critical issue for reasons of space, weight, cost, and stripping.

Thus conventional attempts to produce long fusing nips have tended to increase fuser roller diameter or require use of fusing belts. These approaches have their drawbacks which include increasing the overall size and hence the cost of the fusing apparatus. Additionally, current rubber pressure roller technology is also at its limit as far as increasing nip width by using softer materials.

SUMMARY OF THE INVENTION

According to the present invention, there is provided a compact long nip fusing apparatus including (a) a frame; (b) a rotatable first member for mounting to the frame; (c) a heat source for heating the rotatable first member; and (d) a rotatable and compressable pneumatic member forming a long fusing nip against the rotatable first member for contacting and fusing a fusible image.

DESCRIPTION OF THE DRAWINGS

In the detailed description of the invention presented below, reference is made to the drawings, in which.

DETAILED DESCRIPTION OF THE INVENTION

Figure 1:
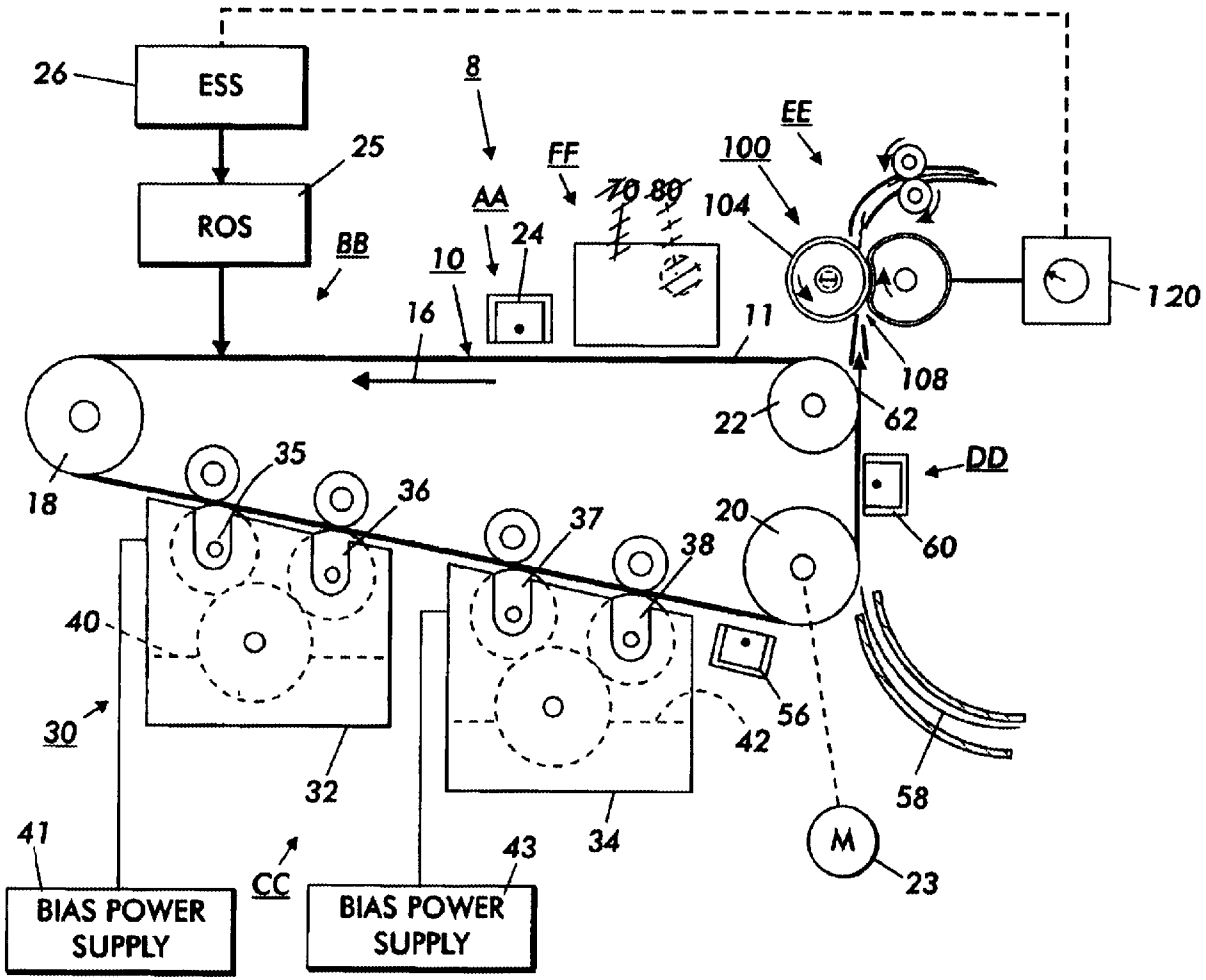
FIG. 1 is a schematic illustration of an electrostatographic reproduction machine incorporating the fusing apparatus including a pneumatic member in accordance with the present invention.

While the present invention will be described in connection with preferred embodiments thereof, it will be understood that it is not intended to limit the invention to those embodiments. On the contrary, it is intended to cover all alternatives, modifications, and equivalents as may be included within the spirit and scope of the invention as defined by the appended claims.

For a general understanding of the features of the present invention, reference is made to the drawings. In the drawings, like reference numerals have been used throughout to identify identical elements.

Referring now to the drawings, where the showings are for the purpose of describing a preferred embodiment of the invention and not for limiting same, and where the various processing stations employed in an electrostatographic reproduction machine as illustrated in FIG. 1, will be described only briefly.

As illustrated, an electrostatographic reproduction machine 8, in which the present invention finds advantageous use, utilizes a charge retentive image bearing member in the form of a photoconductive belt 10 consisting of a photoconductive surface 11 and an electrically conductive, light transmissive substrate. The belt 10 is mounted for movement past a series of electrostatographic process stations including a charging station AA, an exposure station BB, developer station CC, transfer station DD, fusing station EE and cleaning station FE. Belt 10 moves in the direction of arrow 16 to advance successive portions thereof sequentially through the various processing stations disposed about the path of movement thereof. Belt 10 is entrained about a plurality of rollers 18, 20 and 22, the former of which can be used to provide suitable tensioning of the belt 10. Roller 20 is coupled to a motor 23 by suitable means such as a belt drive. Motor 23 rotates roller 20 to advance belt 10 in the direction of arrow 16.

As can be seen by further reference to FIG. 1, initially successive portions of belt 10 pass through charging station AA. At charging station AA, a corona discharge device such as a scorotron, corotron or dicorotron indicated generally by the reference numeral 24, charges the belt 10 to a selectively high uniform positive or negative potential. Any suitable control, well known in the art, may be employed for controlling the corona discharge device 24.

Next, the charged portions of the photoconductive surface 11 are advanced through exposure station BB. At exposure station BB, the uniformly charged photoconductive or charge retentive surface 11 is exposed to a laser based input and/or output scanning device 25 which, as controlled by controller or ESS 26, causes the photoconductive surface 11 to be discharged in accordance with the output from the scanning device 25. The ESS 26, for example, is the main multi-tasking processor for operating and controlling all of the other machine subsystems and printing operations, including aspects of the present invention. The scanning device is a three level laser Raster Output Scanner (ROS). The resulting photoconductive surface 11 contains both charged-area images and discharged-area images.

At developer station CC, a development system, indicated generally by the reference numeral 30 advances developer materials into contact with electrostatic latent images, and develops the images. The development system 30, as shown, comprises first and second developer apparatuses 32 and 34. The developer apparatus 32 comprises a housing containing a pair of magnetic brush rollers 35 and 36. The rollers 35, 36 advance developer material 40 into contact with the photoconductive surface 11 for developing the discharged-area images. The developer material 40, by way of example, contains negatively charged color toner. Electrical biasing is accomplished via bias power supply 41 electrically connected to developer apparatus 32. A DC bias is applied to the rollers 35 and 36 via the bias power supply 41.

The developer apparatus 34 comprises a housing containing a pair of magnetic brush rollers 37 and 38. The rollers 37, 38 advance developer material 42 into contact with the photoconductive surface 11 for developing the charged-area images. The developer material 42 by way of example contains positively charged black toner for developing the charged-area images. Appropriate electrical biasing is accomplished via bias power supply 43 electrically connected to developer apparatus 34. A DC bias is applied to the rollers 37 and 38 via the bias power supply 43.

Because the composite image developed on the photoconductive surface 11 consists of both positive and negative toner, a pre-transfer corona discharge member 56 is provided to condition the toner for effective transfer to a substrate using corona discharge of a desired polarity, either negative or positive.

Sheets of substrate or support material 58 are advanced to transfer station DD from a supply tray, not shown. Sheets 58 are fed from the tray by a sheet feeder, also not shown, and advanced to transfer station DD through a corona charging device 60. After transfer, the sheets 58 continues to move in the direction of arrow 62 towards fusing station EE.

Figure 2:
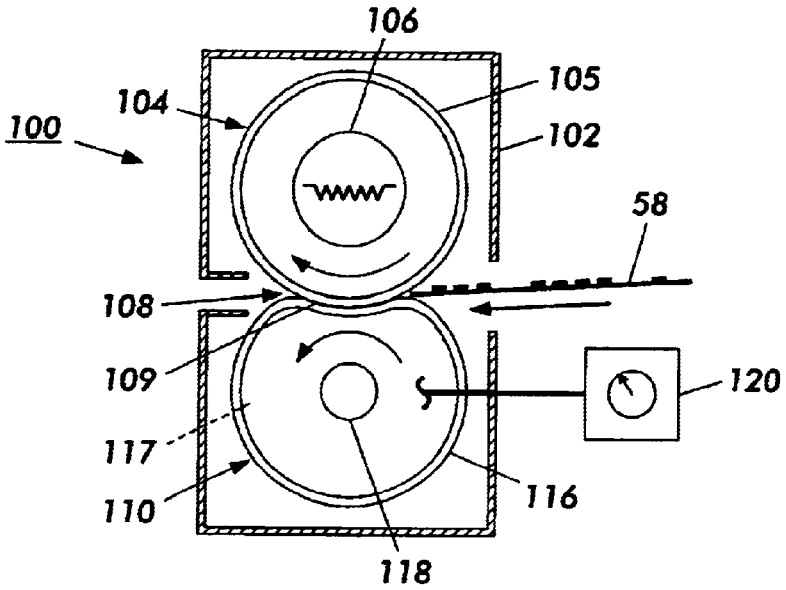
FIG. 2 is a schematic illustration of a first embodiment of the fusing apparatus including a pneumatic member in accordance with the present invention.
Figure 3:
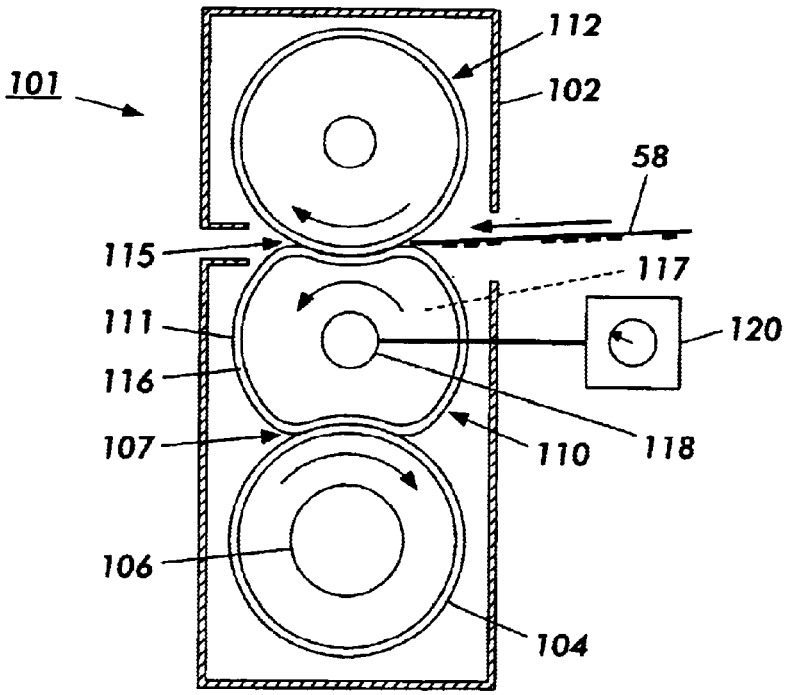
FIG. 3 is a schematic illustration of a second embodiment of the fusing apparatus including a pneumatic member in accordance with the present invention.

Referring now to FIGS. 1–3, fusing station EE includes the fusing apparatus 100 or 101 which comprises a frame 102 a rotatable first member 104 that is heated, for example by a heating device 106 (shown as an internal lamp but as well could be an external heater). The fusing apparatus 100 and 101 also includes a rotatable and compressable pneumatic member 110 in accordance with the present invention. As illustrated, the first member 104 forms a long fusing nip 108 with the rotatable and compressable pneumatic member 110 for fusing toner images carried on a copy sheet or substrate 58. The heating device 106 is sufficient for elevating temperatures within the fusing nip 108 to a suitable level for fusing toner particles.

In a first embodiment of the fusing apparatus 100 of the present invention as shown in FIG. 2, the heated, rotatable first member 104 is arranged as a fusing member. As such, it has a surface 105 that is suitable for contacting and fusing toner images. Accordingly, the rotatable and compressable pneumatic member 110 is therefore arranged in this embodiment as a pressure member for contacting a backside of the copy sheet or substrate 58 within the fusing nip 108.

In a second embodiment of the fusing apparatus 101 of the present invention as shown in FIG. 3, the rotatable and compressable pneumatic member 110 is arranged as the fusing member, and thus has a surface 111 that is suitable for contacting and fusing toner images. In this embodiment, the heated, rotatable first member 104 is arranged as an external heating device forming a heating nip 107 against the pneumatic member 110 for heating the surface 111 of the pneumatic member 110. Alternatively, the rotatable and compressable pneumatic member 110 can also be heated internally for example by using a controllably heated fluid 117 for pressurizing the pneumatic member 110. A rotatable second member 112 is provided as a pressure member and is mounted in nip forming pressure engagement with the pneumatic member 110 and forms a long fusing nip 115, and for contacting a backside of the copy sheet or substrate 58 within the fusing nip 115.

In both embodiments, the rotatable and compressable pneumatic member 110 can for example be comprised of a flexible, pressurized or pressurizeable sleeve or shell 116 that is mounted on a rigid core 118. The rigid core 118 typically can be made of a metallic material. As illustrated in the second embodiment, the rotatable and compressable pneumatic member 110, is positioned between a conventional hard pressure roller which is the rotatable second member 112 forming the fusing nip 115, and an external heat roller which is the rotatable first member 104. The sleeve or shell 116 can be made of a thermally conductive material such as silicone rubber with a conductive filler for receiving and retaining heat for example from the external heating device 104 or the fluid 117 inside.

The rotatable and compressable pneumatic member 110 in a fusing apparatus has many benefits including the long fusing nip 108 and 115 which advantageously results in increased dwell time for images being fused through such a nip. The long nip allows the fusing apparatus to run at a relatively higher speed, and higher copy volume. Additionally, it produces relatively high uniformity in nip pressure from entrance to exit, as well as relatively low strain levels on sleeve material, resulting in a relatively longer life fusing apparatus. In loading the rotatable and compressable pneumatic member 110 within the fusing nip 108 and 115, external loading means may not be necessary because the rotatable and compressable pneumatic member 110 itself is, and can act as an integrally adjustable pneumatic spring.

Thus as shown in FIGS. 1–3, there is illustrated a compact long nip fusing apparatus 100 and 101 in accordance with the present invention. As shown, the compact long nip fusing apparatus 100 and 101 includes a frame 102; a rotatable first member 104 for mounting to the frame; a heating device or heat source 106 for heating the rotatable first member 104; and a rotatable and compressable pneumatic member 110 forming a long fusing nip 108 and 115 against the rotatable first member 104.

In the first embodiment shown in FIG. 2, the rotatable first member 104 comprises a roller which as heated can be a fuser roller having a surface 105 that is suitable for contacting and fusing toner images. The heat source 106 for example is mounted internally within the rotatable first member or roller 104, but as is well known, the heat source 106 can also be externally located relative to the rotatable first member or roller 104.

The rotatable and compressable pneumatic member 110 comprises a flexible, hollow sleeve or shell 116 that can be filled and pressurized by means of a pressurized fluid such as air, a gas or a suitable liquid. The volume and pressure of such fluid within the hollow sleeve or shell 116 determines the size and firmness of the rotatable and compressable pneumatic member 110. As shown, the rotatable and compressable pneumatic member 110 may include a constant pressure control means 120 coupled thereto for maintaining its pressure at a constant level, or the control means 120 may be a variable pressure control means for varying its pressure and fusing nip pressure responsively to the requirements of different types of fusing jobs.

In the first embodiment (FIG. 2), the rotatable first member 104 and the rotatable and compressable pneumatic member 110 are mounted into pressure contact (by means not shown) within the long fusing nip 108. The long fusing nip 108 has an arcuate profile 109 that is formed by the rotatable first member 104 compressing the rotatable and compressable pneumatic member 110.

In the second embodiment, the compact long nip fusing apparatus 101 includes the frame 102, the rotatable and compressable pneumatic member 110, and the rotatable first member 104 with the heating device 106 therein. As shown, the rotatable first member 104 with the heating device 106 therein forms a heating nip 107 against the rotatable and compressable pneumatic member 110. This embodiment of the fusing apparatus 101 also includes a rotatable second member 112 that is mounted oppositely from the rotatable first member 104 relative to, and forming a long fusing nip 115 with, the rotatable and compressable pneumatic member 110. In this second embodiment, the rotatable and compressable pneumatic member 110 is heated externally by the rotatable first member 104 through the heating nip 107. The externally heated rotatable and compressable pneumatic member 110 serves thus as the fusing member, and thus has a surface 111 that is suitable for contacting and fusing toner images.

As also shown, the rotatable and compressable pneumatic member 110 of the second embodiment may include a constant pressure control means 120 coupled thereto for maintaining its pressure at a constant level, or the control means 120 may be a variable pressure control means for varying its pressure and fusing nip pressure responsively to the requirements of different types of fusing jobs.

The rotatable and compressable pneumatic member 110 is pressurized using a fluid 117, such as a gas, air or a liquid. After pressurization, the rotatable and compressable pneumatic member 110 can be permanently sealed to operate at a fixed pressure or its pressure can be variably controlled using an adjustable variable pressure control means 120 as above.

As can be seen, there has been provided a compact long nip fusing apparatus including (a) a frame; (b) a rotatable first member for mounting to the frame; (c) a heat source for heating the first rotatable member; and (d) a rotatable and compressable pneumatic member forming a long fusing nip against the first rotatable member for contacting and fusing a fusible image.

While this invention has been described in conjunction with a particular embodiment thereof, it shall be evident that many alternatives, modifications and variations will be apparent to those skilled in the art. Accordingly, the present invention is intended to embrace all such alternatives, modifications and variations as fall within the spirit and broad scope of the appended claims.

What is claimed is:

1. A compact long nip fusing apparatus comprising:

a. a frame;

b. a rotatable first member for mounting to said frame;

c. a heat source for heating said rotatable first member; and d. a rotatable and compressable pneumatic member forming a long fusing nip against said rotatable first member for contacting and fusing a fusible image.

2. The compact long nip fusing apparatus of claim 1, wherein said rotatable first member comprises a roller.

3. The compact long nip fusing apparatus of claim 2, wherein said roller comprises a fuser roller having a surface suitable for contacting and fusing toner images.

4. The compact long nip fusing apparatus of claim 1, wherein said heat source is mounted internally within said rotatable first member.

5. The compact long nip fusing apparatus of claim 1, wherein said rotatable and compressable pneumatic member includes a constant pressure control means coupled thereto for maintaining its pressure at a constant level.

6. The compact long nip fusing apparatus of claim 1, wherein said rotatable and compressable pneumatic member includes a variable pressure control means coupled thereto for varying its pressure and fusing nip pressure responsively to different types of fusing jobs.

7. The compact long nip fusing apparatus of claim 1, wherein said rotatable first member and said rotatable and compressable pneumatic member are mounted in pressure contact within said long fusing nip.

8. The compact long nip fusing apparatus of claim 1, wherein said long fusing nip has an arcuate profile formed by said rotatable first member compressing said rotatable and compressable pneumatic member.

9. The compact long nip fusing apparatus of claim 1, including a rotatable second member mounted oppositely from said rotatable first member relative to, and forming a long drive nip with, said rotatable and compressable pneumatic member.

10. The compact long nip fusing apparatus of claim 9, wherein said rotatable and compressable pneumatic member comprises a fuser member having a surface suitable for contacting and fusing toner images.

11. An electrostatographic reproduction machine comprising:

a. a movable image bearing member having a toner image carrying surface defining a path of movement therefor;

b. electrostatographic devices mounted along said path of movement for forming a toner image on said toner image carrying surface;

c. means for transferring said toner image from said toner image carrying surface onto a substrate; and d. a long nip width fusing apparatus for heating and fusing said toner image onto said substrate, said long nip width fusing apparatus including:

(i) a frame;

(ii) a rotatable first member for mounting to said frame;

(iii) a heat source for heating said rotatable first member; and (iv) a rotatable and compressable pneumatic member forming a long fusing nip against said rotatable first member for contacting and fusing a fusible image.

12. The electrostatographic reproduction machine of claim 11, wherein said rotatable first member comprises a roller.

13. The electrostatographic reproduction machine of claim 12, wherein said roller comprises a fuser roller having a surface suitable for contacting and fusing toner images.

14. The electrostatographic reproduction machine of claim 11, wherein said heat source is mounted internally within said rotatable first member.

15. The electrostatographic reproduction machine of claim 11, wherein said rotatable and compressable pneumatic member includes a constant pressure control means coupled thereto for maintaining its pressure at a constant level.

16. The electrostatographic reproduction machine of claim 11, wherein said rotatable and compressable pneumatic member includes a variable pressure control means coupled thereto for varying its pressure and fusing nip pressure responsively to types of fusing jobs.

17. The electrostatographic reproduction machine of claim 11, wherein said rotatable first member and said rotatable and compressable pneumatic member are mounted in pressure contact within said long fusing nip.

18. The electrostatographic reproduction machine of claim 11, wherein said long fusing nip has an accurate profile formed by said rotatable first member compressing said rotatable and compressable pneumatic member.

19. The electrostatographic reproduction machine of claim 11, including a rotatable second member mounted oppositely from said rotatable first member relative to, and forming a long drive nip with, said rotatable and compressable pneumatic member.

20. The electrostatographic reproduction machine of claim 19, wherein said rotatable and compressable pneumatic member comprises a fuser member having a surface suitable for contacting and fusing toner images.

* * * * *